US007621780B2

(12) United States Patent
Magnusson

(10) Patent No.: US 7,621,780 B2
(45) Date of Patent: Nov. 24, 2009

(54) SHIELDING DEVICE AND METHOD FOR ELECTRICAL CONNECTORS

(75) Inventor: Per Magnusson, Linkoping (SE)

(73) Assignee: General Instrument Corporation, Horsham, PA (US)

( * ) Notice: Subject to any disclaimer, the term of this patent is extended or adjusted under 35 U.S.C. 154(b) by 0 days.

(21) Appl. No.: 12/026,835

(22) Filed: Feb. 6, 2008

(65) Prior Publication Data

US 2008/0188126 A1 Aug. 7, 2008

Related U.S. Application Data

(60) Provisional application No. 60/888,425, filed on Feb. 6, 2007.

(51) Int. Cl.
*H01R 13/648* (2006.01)

(52) U.S. Cl. ..... 439/607.23; 439/607.54

(58) Field of Classification Search ..... 439/607, 439/541.5, 939, 607.01, 607.23, 607.54; 174/350, 351, 354, 355, 359; 361/816, 818
See application file for complete search history.

(56) References Cited

U.S. PATENT DOCUMENTS

| | | | | |
|---|---|---|---|---|
| 3,366,918 | A * | 1/1968 | Johnson et al. | 439/607.28 |
| 6,346,009 | B1 * | 2/2002 | Lin | 439/607.01 |
| 6,699,071 | B1 * | 3/2004 | Hyland | 439/607 |
| 7,311,556 | B2 * | 12/2007 | Wan et al. | 439/607 |
| 2002/0142656 | A1 * | 10/2002 | Chang | 439/607 |

* cited by examiner

*Primary Examiner*—Edwin A. Leon
*Assistant Examiner*—Vanessa Girardi
(74) *Attorney, Agent, or Firm*—Stewart M. Wiener

(57) ABSTRACT

A shield for reducing impedance of a shielding of a SCART connector at high frequencies, the shield including a metallic sheet having a first end and a second end where each of the first and second ends extends along and adjacent to a surface of a SCART connector socket. A shielding assembly and a method for shielding a SCART connector are also disclosed.

9 Claims, 10 Drawing Sheets

SHIELDING DEVICE AND METHOD FOR ELECTRICAL CONNECTORS

CROSS-REFERENCE TO RELATED PATENT APPLICATIONS

This patent application claims the benefit of U.S. Provisional Patent Application No. 60/888,425, filed Feb. 6, 2007 which is incorporated by reference herein in its entirety.

BACKGROUND

SCART connectors are audio/video connectors used primarily in Europe. Typically, SCART connectors are attached to a set-top-box which may also be known as a cable converter box. They are also attached to individual pieces of audio/visual equipment such as televisions and VCRs. A SCART connector has 21 independent pin type connectors that allow one to connect audio/video equipment together.

A SCART connector makes it easy to connect AV equipment (including televisions, VCRs, DVD players and game consoles). In essence, it gathers together various common analog signal-types into a single connector. Generally, prior to the development of SCART, each of the various analog signals would have had their very own socket, requiring numerous separate connections and a "spaghetti" type mass of leads. The signals carried by SCART include both composite and RGB video and stereo audio input/output, as well as support functions. Certain pins in a SCART are designated as intelligent pins as they carry out AV auto switching, wide screen switching and RGB status switching. The term "fully wired" typically means that all of the SCART's 21 pins are connected enabling it to carry most of the AV signals with stereo audio; composite, SVHS, and RGB signals.

The SCART connector is standard on most European audio visual equipment. SCART makes it easier to connect video devices together by providing one plug that contains all the necessary signals and is standard across different manufacturers. One cable can connect any two SCART-compatible devices, and the connector is designed so that it cannot be inserted incorrectly.

Some connectors like the SCART audio/video connector support a shielded cable and shielded cable connector, despite the fact that the mating board mounted connector typically does not provide a good low impedance high frequency path from the shield of the cable connector to the metal chassis of the products enclosure. This can lead to EMC problems as high frequency electromagnetic radiation above the EMC regulation limits (e.g., FCC or CE) can easily escape the product through the cables where the shielding is rendered ineffective due to improper high frequency grounding of the cable shields.

BRIEF DESCRIPTION OF THE DRAWINGS

The accompanying figures where like reference numerals refer to identical or functionally similar elements throughout the separate views, and which together with the detailed description below are incorporated in and from part of the specification, serve to further illustrate various embodiments and to explain various principles and advantages all in accordance with aspects of the present invention.

DETAILED DESCRIPTION OF THE EMBODIMENTS

Figure 1:
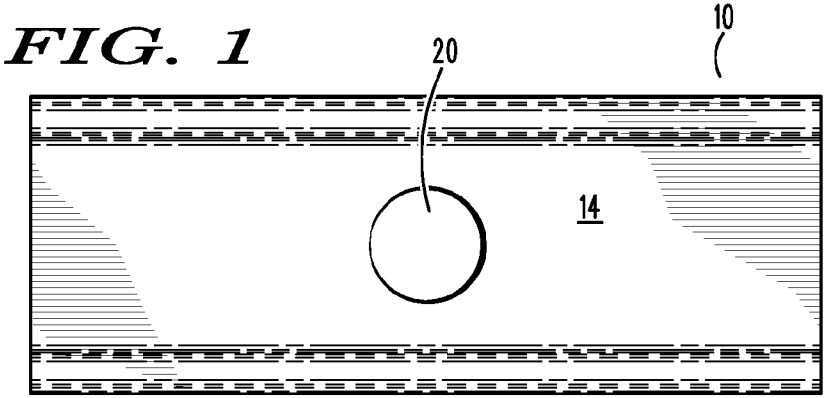
FIG. 1 is top view of a shield for reducing impedance of a female portion of a dual SCART connector according to an embodiment.

Before describing in detail embodiments that are in accordance with the present invention, it should be observed that the embodiments reside primarily in combinations of method steps and apparatus components related to a shield used with a SCART connector. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

Figure 2:
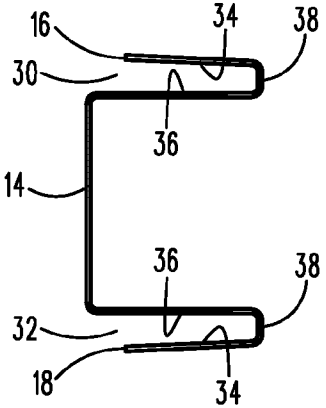
FIG. 2 is a side view of a shield for reducing impedance of a female portion of a dual SCART connector according to an embodiment.
Figure 3:
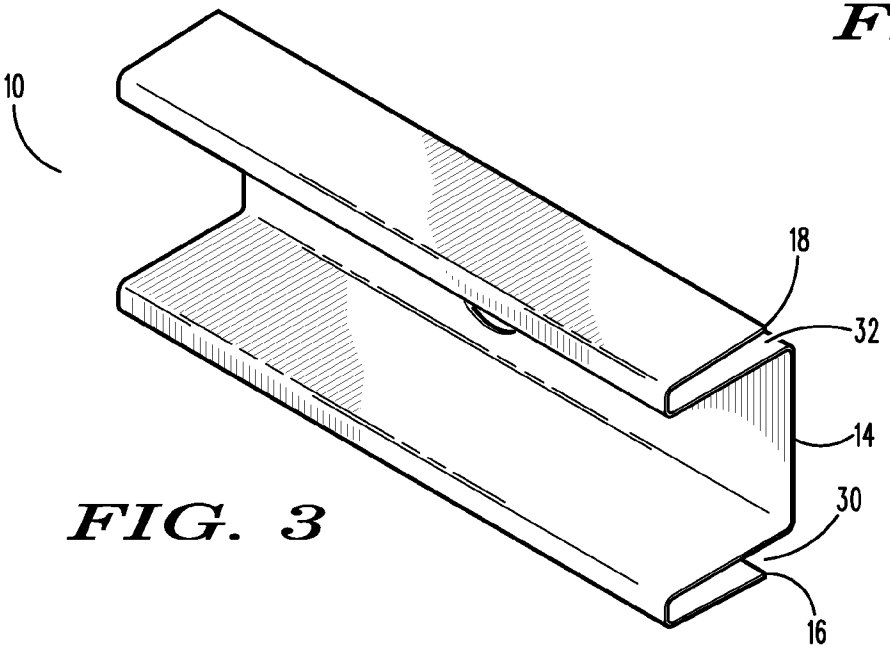
FIG. 3 is a perspective view of a shield for reducing impedance of a female portion of a dual SCART connector according to an embodiment.
Figure 4:
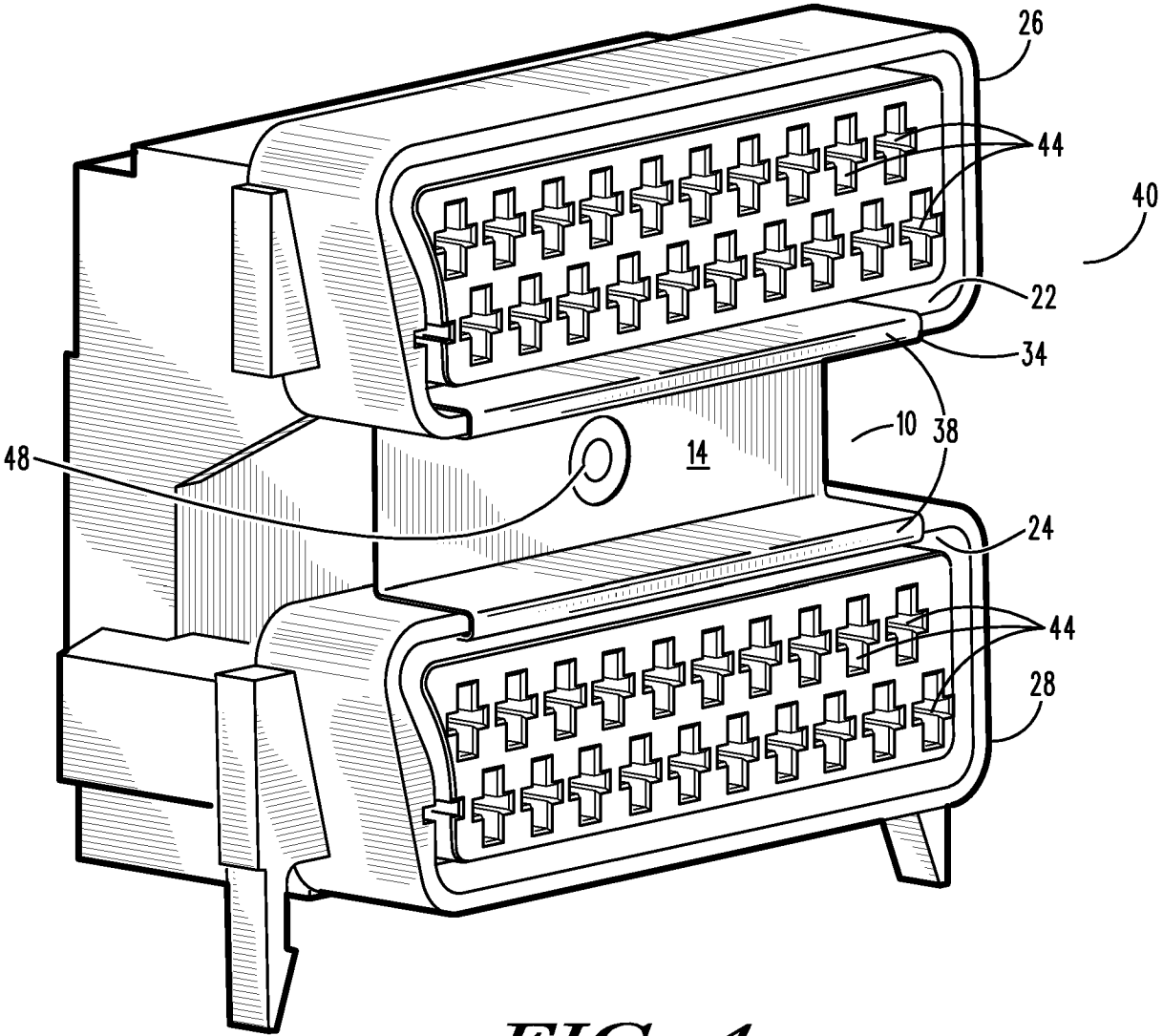
FIG. 4 is a perspective view of a female portion of a dual SCART socket showing an embodiment of an impedance reducing shield attached to the connector.
Figure 5:
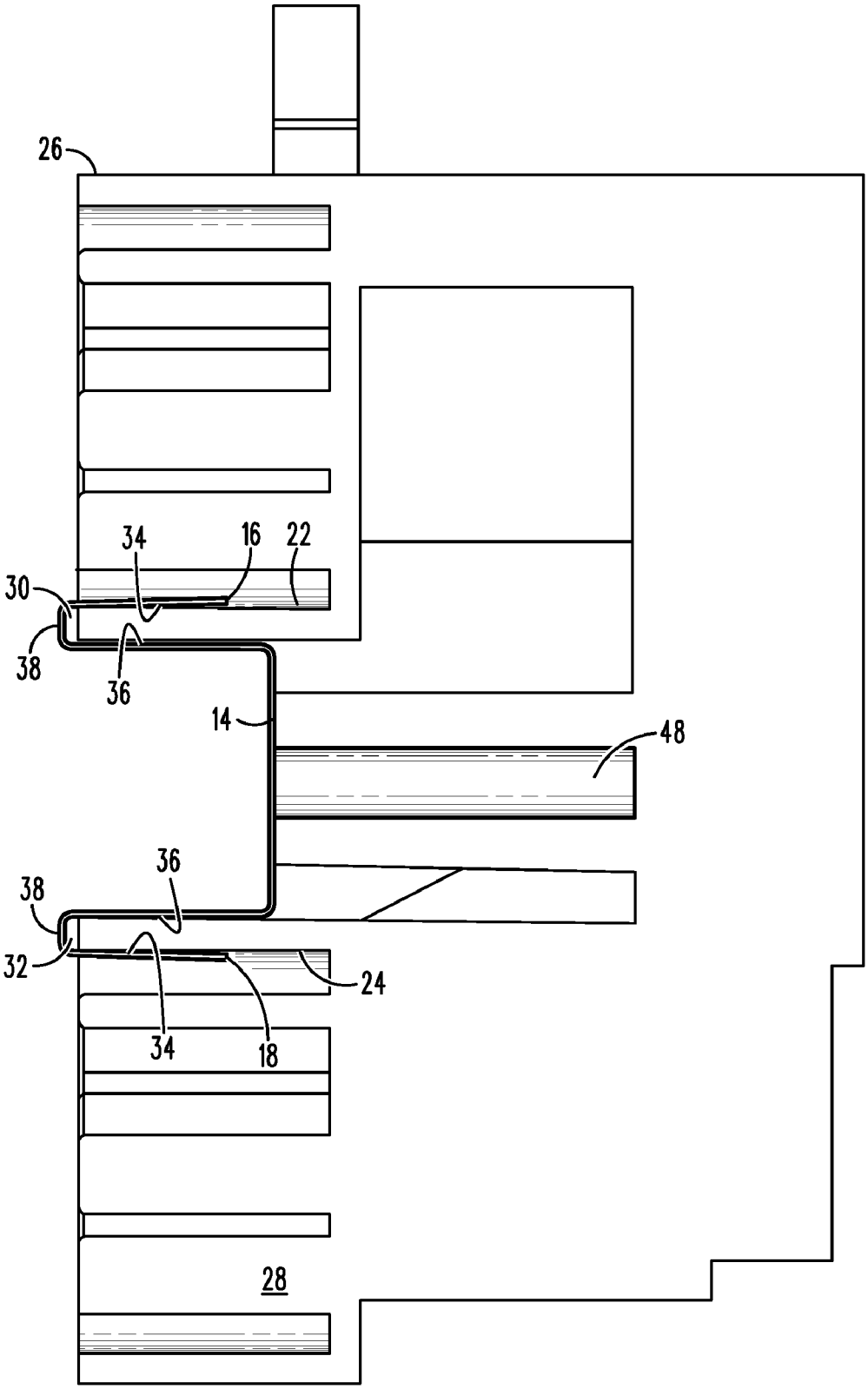
FIG. 5 is a sectional view of a female portion of a dual SCART socket shown in FIG. 4, according to an embodiment.
Figure 6:
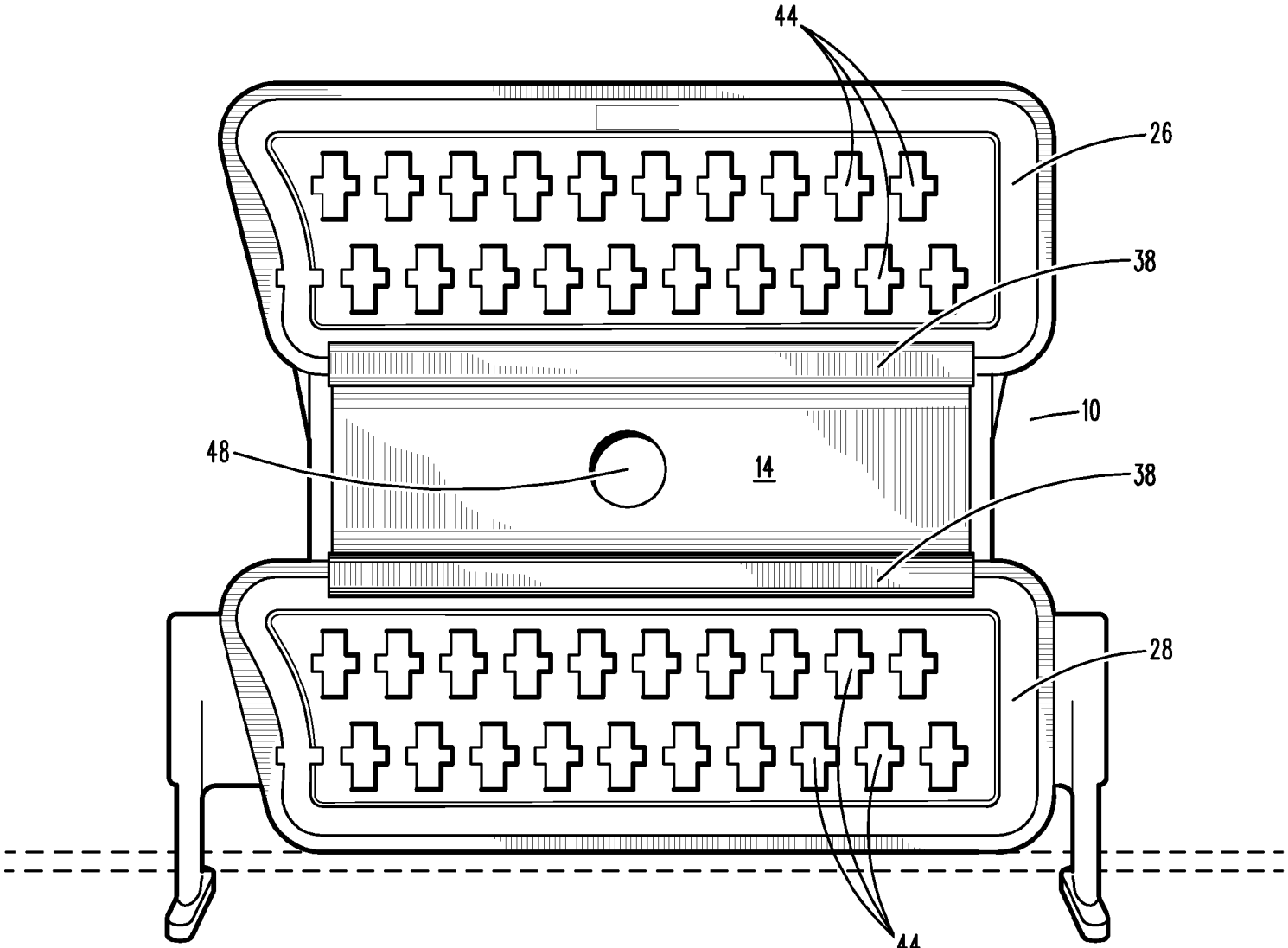
FIG. 6 is a front view of a female portion of a dual SCART socket showing an embodiment of an impedance reducing shield attached to the connector.

Aspects of the invention are able to provide a high frequency, low impedance path from a cable shield to a product chassis. An invention embodiment relates to a shield 10 for reducing the impedance of a SCART connector 12 at high frequencies, as shown in FIGS. 1-3. The shield 10 is comprised of a metallic sheet 14 having a first end 16 and a second end 18, an opening 20 may be located between the first and second end 16, 18. Each of the first and second end 16, 18 extend along and adjacent to a surface 22, 24 of a respective first 26 and second 28 connector socket (i.e., the female portion), as shown in FIGS. 4-6. In an embodiment, the opening 20 is intermediate to the first and second end, as shown in FIG. 1.

In the embodiment shown in FIGS. 1-3, the metallic sheet 14 defines a first and second channel 30, 32 between the respective first 16 and second end 18 and the opening 20. Each of the channels 30, 32 has a first side wall 34 terminating at the respective first and second ends 16, 18. A second side wall 36 is located opposite the first side wall 34 and proximate to the opening 20 between the first and second ends 16, 18. A top wall 38 connects the respective first and second side walls 34, 36. In an embodiment, the top wall 38 may be substantially perpendicular to the first and second side walls 34, 36.

Figure 9:
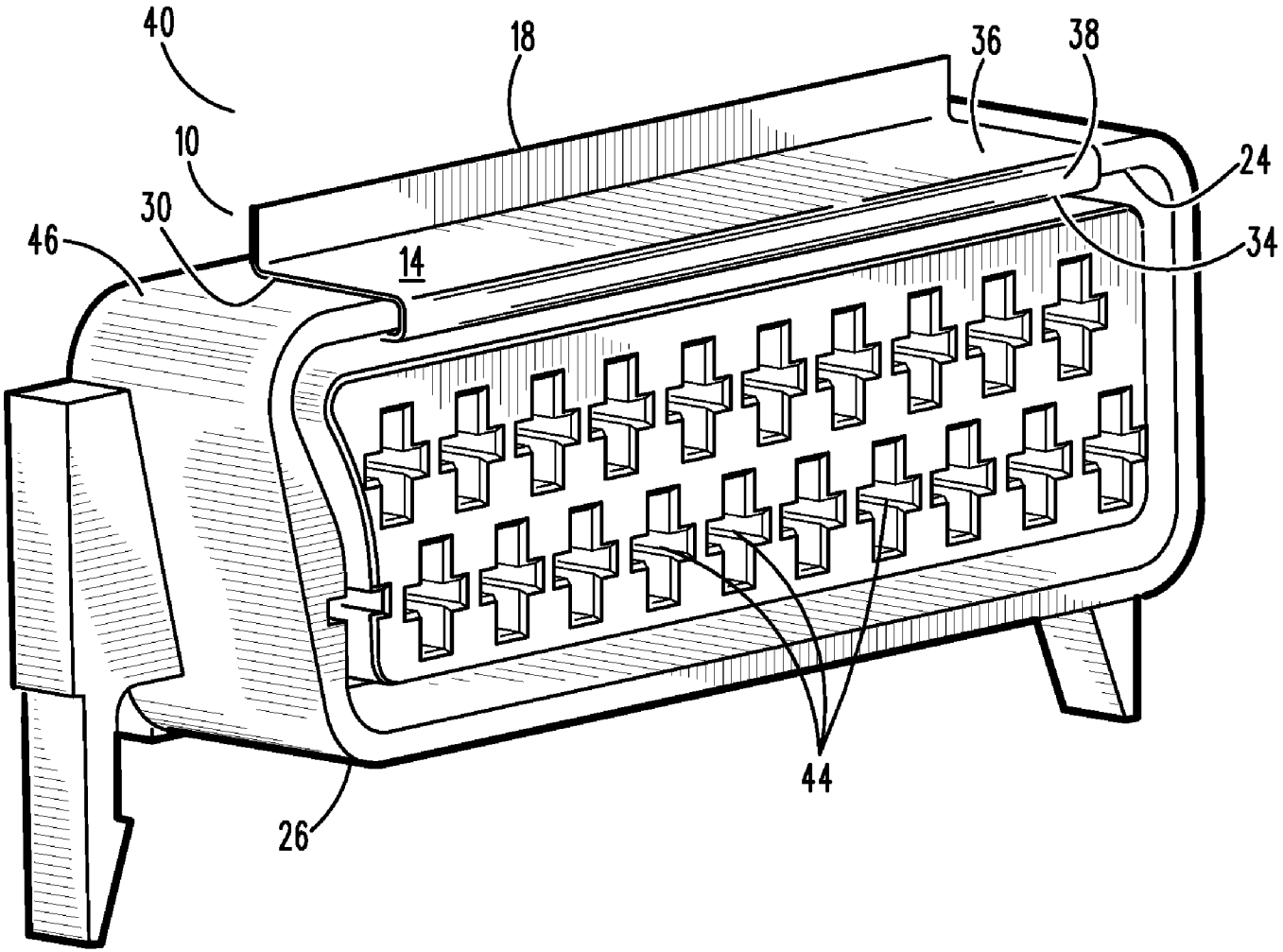
FIG. 9 is a perspective view of a female portion of a single SCART connector showing an embodiment of an impedance reducing shield attached to the connector.

In the embodiment as shown in FIG. 9, the shield 10 is comprised of a metallic sheet 14 having a first end (not shown) and a second end 18 with a channel 30 between the first end and the second end 18. The channel 30, which is capable of receiving a portion of the SCART connector 26, has a first side wall 34 terminating at the first end, a second side wall 36 terminating at the second end 18 with the second end 18 angled approximately 90° from a plane defined by the second side wall 36, and a top wall 38 connecting the respective first and second side walls 34, 36. The top wall 38 may be substantially perpendicular to the first and second side walls 34, 36.

Figure 7:
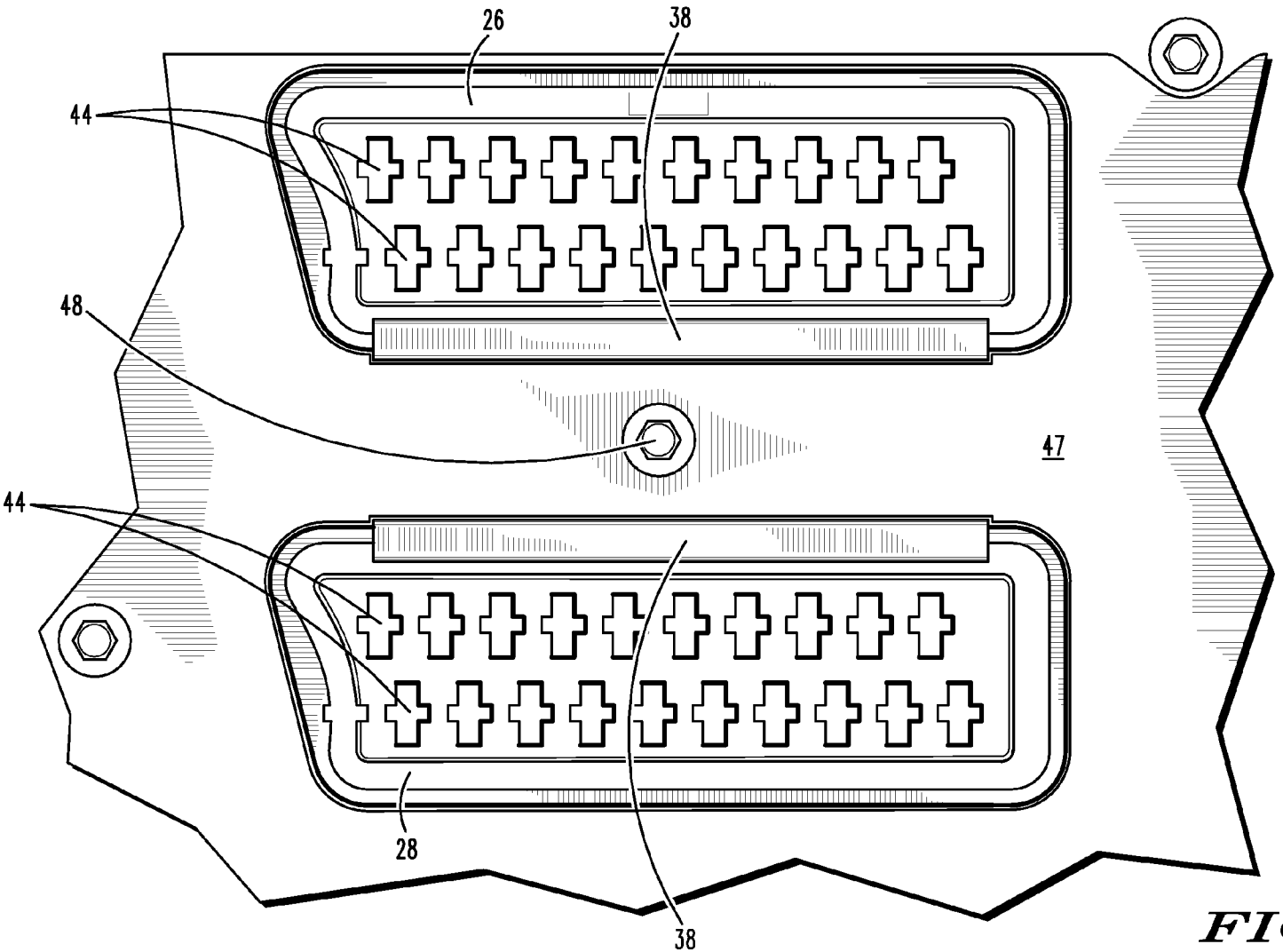
FIG. 7 is a front view of a female portion of a dual SCART socket showing the sockets extending through a chassis of a piece of electronic equipment, according to an embodiment.

Another aspect of the invention is directed to an assembly 40 for reducing impedance of a SCART connector 26 at high frequencies, the assembly is comprised of a metallic shield 14 having a first end 16 and a second end 18. As shown in FIG. 9, in an embodiment, the metallic shield 14 has the first end (not shown) positioned adjacent to a first surface 24 of a SCART socket 26 proximal to a plurality of SCART receiving sockets 44 and a second end 18 adjacent to a second surface 25 of the SCART socket 24 distal to the plurality of SCART receiving sockets 44. A chassis 47, surrounding a particular piece of electronic equipment is connected to the SCART socket 26 so that the chassis 47 contacts a portion of the metallic shield 10 adjacent to the second surface 25 of the SCART socket 26, as shown in FIG. 7.

In an embodiment of the assembly 40, the metallic shield 10 is a metallic sheet 14 with a first end 16 and a second end 18. An opening 20 exists between the first and second end 16, 18, and each of the first and second ends 16, 18 extends along and adjacent to a surface 22, 24 of a respective first and second connector socket 26, 28, as shown in FIGS. 4-6. The opening 20 may be intermediate to the first and second end 16, 18, in a particular embodiment.

In another embodiment the metallic sheet 14 defines a first and second channel 30, 32 between the respective first and second end 16, 18 and the opening 20. As shown in FIGS. 1-3 and FIG. 5, each of the channels 30, 32 has a first side wall 34 terminating at the respective first and second ends 16, 18, a second side wall 36 opposite the first side wall 34 and proximate to the opening 20 between the first and second ends 16, 18. A top wall 38 connects the first 16 and second 18 side walls. When in use, a portion of a first connector socket 26 is positioned within the first channel 30 and a portion of a second connector socket 28 is positioned within the second channel 32, as shown in FIGS. 4-6.

In the embodiment, the first and second side walls 34, 36 of the respective channels 30, 32 are substantially perpendicular to a portion of the metallic sheet 14 defining the opening 20. The second side wall 36 of each respective channel 30, 32 is adjacent to the chassis 47, as shown in FIG. 7.

As shown in FIGS. 4-7, a connecting device 48 may extend through the opening 20. This connecting device 48 may be a self-tapping connecting bolt or any other suitable connector without departing from the scope and spirit of the invention.

Figure 8:
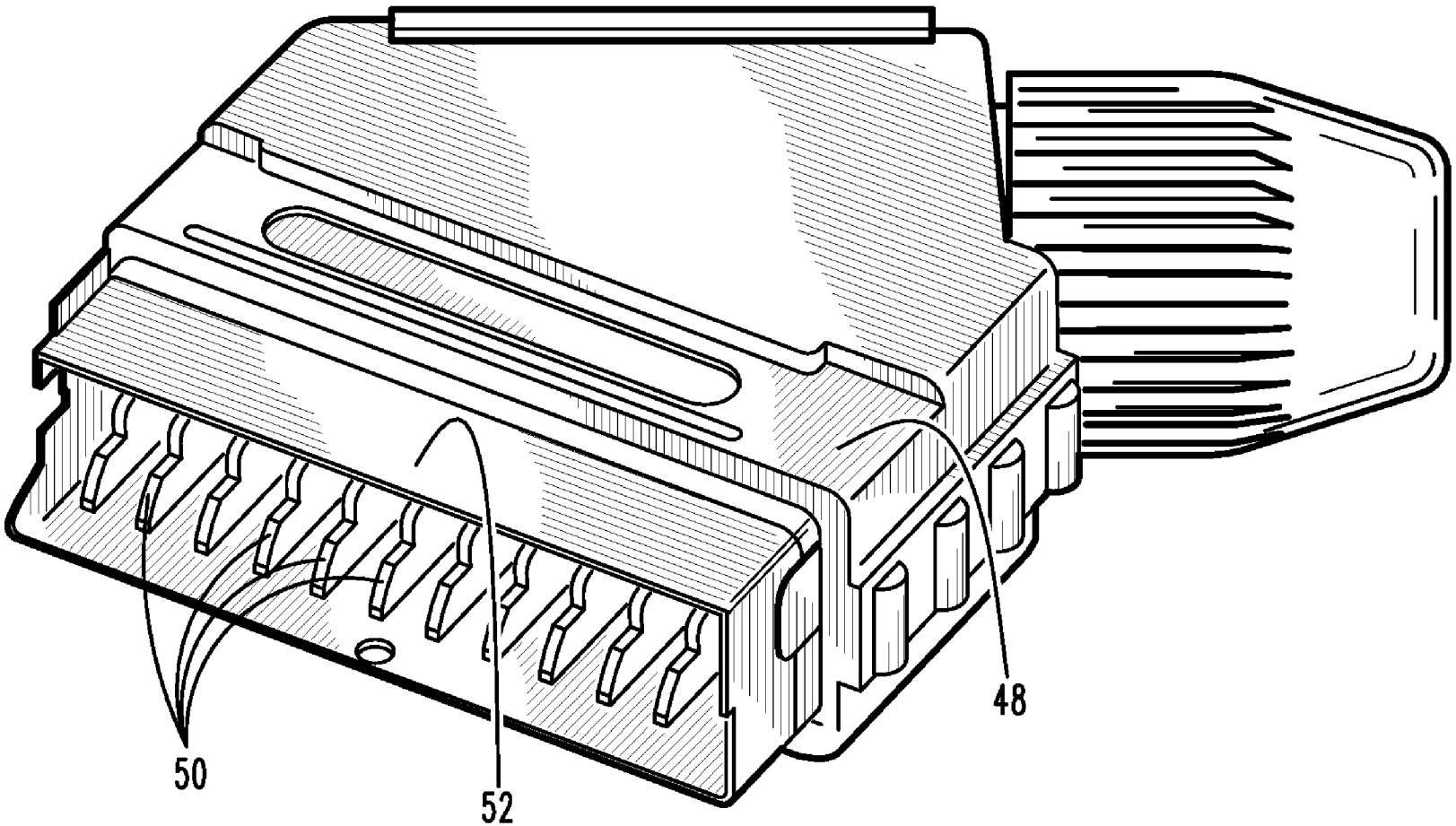
FIG. 8 is a perspective view of a male portion of a SCART connector, according to an embodiment.

When in operation, a mating end 50 of a SCART connector 52, as shown in FIG. 8, is inserted into a SCART socket 26 so that the connecting pins 54 of the connector 52 engage the respective openings 44 in the socket 26. This connection is made in much the same way that a cable connector for a peripheral, such as a mouse or printer, is generally connected to a personal computer.

In making the connection, the metallic shield 56 of the SCART connector 52 engages the SCART socket 26 such that it contacts the first side wall 34 of the metallic shield 14 attached to the socket 26. The chassis 47 of the electrical component is made of a conductive material and is also in contact with the second side wall 36 of the shield 14. This sets up an electrical connection between the shield 56 of the connector 52 and the chassis 47.

To obtain a low inductance, it is beneficial to make a wide electrical connection. It is known that a given length of a wide band of sheet metal has a lower inductance than the same length of a thin wire. Several thin wires in parallel also have a lower inductance than a single wire, but higher inductance that a wide band of metal. In order to make a low inductance connection from the shield 56 of the SCART connector 52 (i.e., the male portion) via the shield 10 attached to the SCART socket 26 (i.e., the female portion) to the conductive chassis 47 of the product, it is desirable to make the connection as wide as possible. This is accomplished by making the sheet metal piece 14 connect to the chassis 47 not at a single point, but at several points or along a continuous stretch of the perimeter of the hole 58 in the chassis 47 in which the female portion of the SCART connector 26 protrudes, as shown in FIG. 7.

Figure 10:
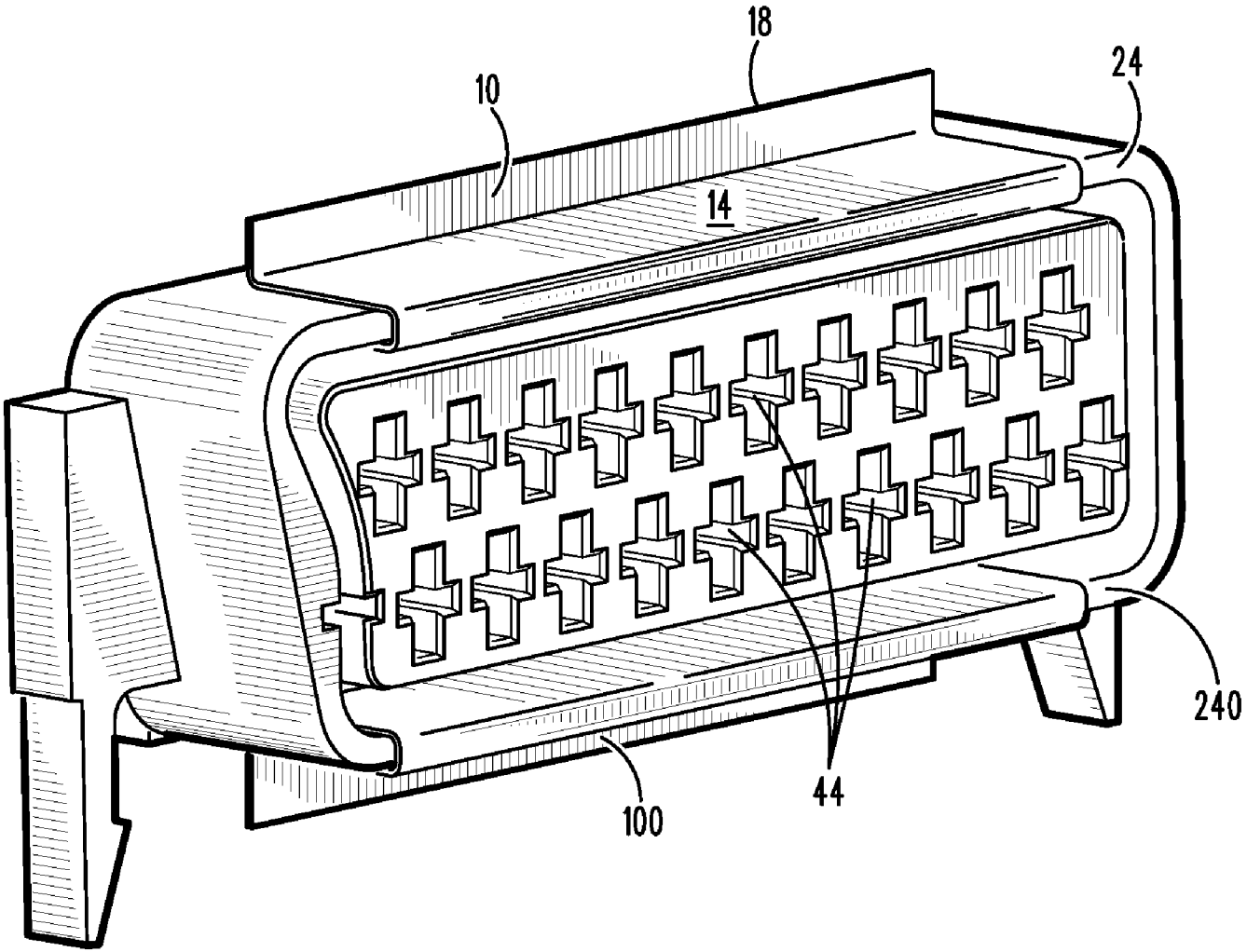
FIG. 10 is a perspective view of a female portion of a single SCART connector showing an embodiment of an impedance reducing shield attached to the connector.
Figure 11:
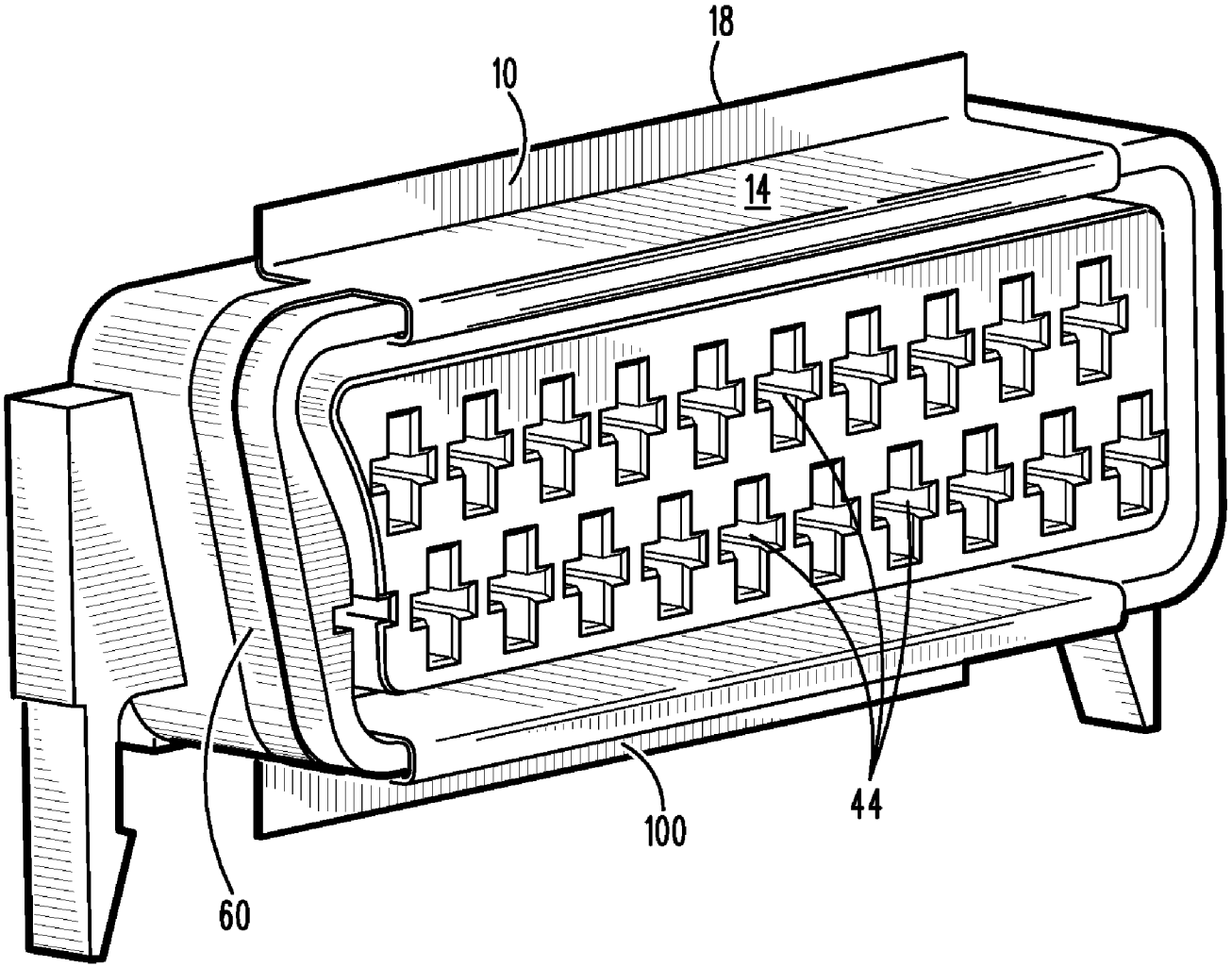
FIG. 11 is a perspective view of a female portion of a single SCART connector showing an embodiment of an impedance reducing shield attached to the connector.

Although FIGS. 4-7 show the shield 10 attached to a dual SCART connector 26, 28, the shield 10 could be used with a single SCART 26, as shown in FIGS. 9-11, without departing from the scope and spirit of the invention. In one embodiment, as shown in FIG. 9, the assembly 40 is comprised of a single metallic shield 10 having a first end (not shown) and a second end 18. The metallic sheet 14 defines a channel 30 between the first end and the second end 18 with the channel 30 having a first side wall 34 terminating at the first end, a second side wall 36 terminating at the second end 18 with the second end 18 angled approximately 90° from a plane defined by the second side wall 36, and a top wall 38 connecting the respective first and second side walls 34, 36. In the assembly, the first side wall 34 of the metallic shield 10 is positioned adjacent to a first surface 24 of a SCART sidewall proximal to a plurality of SCART receiving sockets 44 and the second side wall 36 of the metallic shield 10 is adjacent to a second surface 25 of the SCART sidewall distal to the plurality of SCART receiving sockets 44. A chassis 47, surrounding a particular piece of electronic equipment connected to the SCART is positioned adjacent to the second sidewall 36 of the metallic shield 10.

In another embodiment, as shown in FIG. 10, a second metallic shield 100 is positioned adjacent to a second sidewall of the SCART opposite the first sidewall. In still another embodiment of the assembly, a metallic band 60 connects the two metallic shields 10, 100 by extending around an outer sidewall of the SCART connector, as shown in FIG. 11. In a more particular version of this embodiment, a second metallic band connects the two metallic shields, said second metallic band extending around an outer sidewall of the SCART connector opposite the first metallic band.

Figure 12:
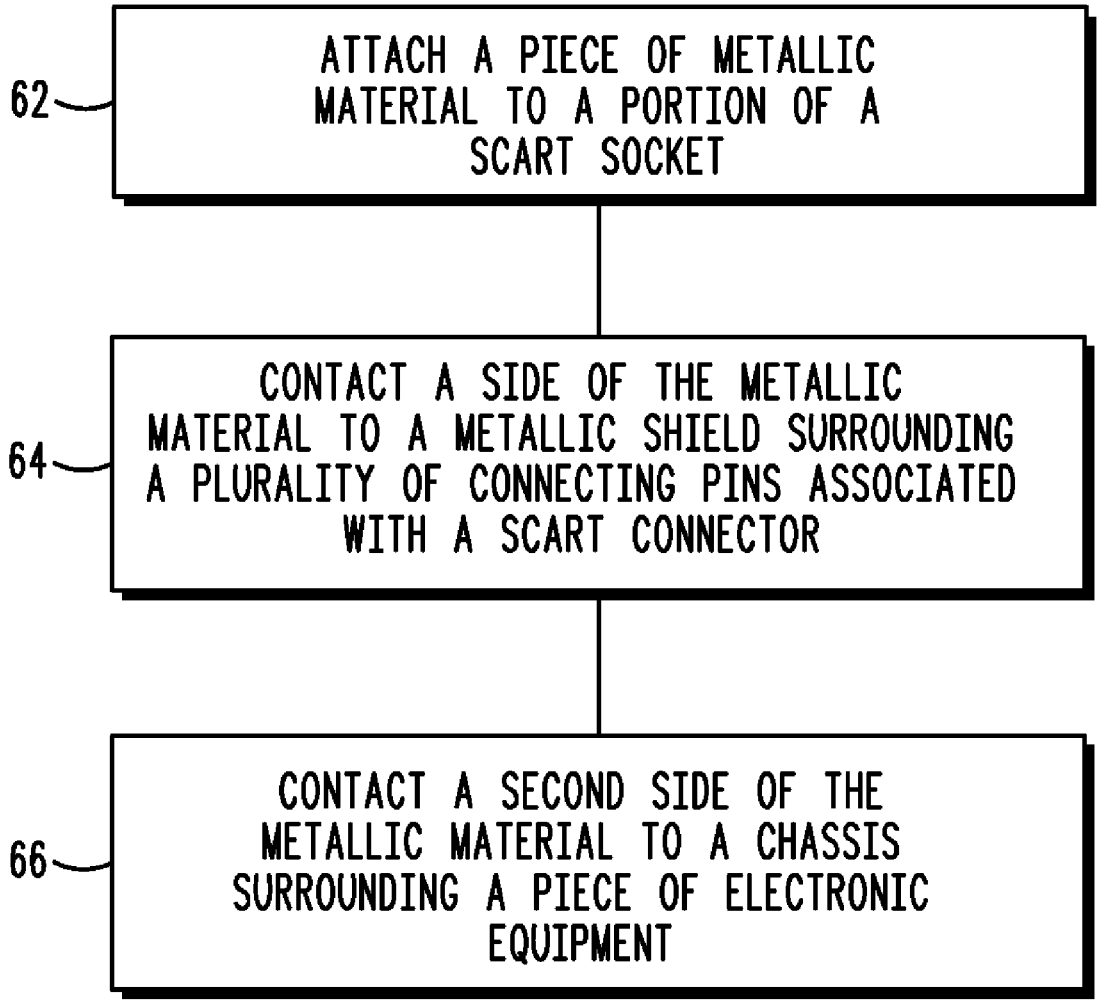
FIG. 12 is a flow chart showing a method for reducing impedance of a SCART connector at high frequencies according to an embodiment.

Aspects of the invention also involve a method of reducing impedance of a SCART connector at high frequencies. As shown in FIG. 12, the method is comprised of: (1) attaching a piece of metallic material to a portion of a SCART socket 62; (2) contacting a first side of said piece of metallic material to a metallic shield surrounding a plurality of connecting pins associated with a SCART connector inserted into the SCART socket 64; and (3) contacting a second side of said piece of metallic material to a conductive chassis surrounding a particular piece of electronic equipment connected to the SCART socket 66.

The metallic material may be attached to the SCART socket in any suitable manner including, but not limited to, bolting the material to the socket.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. A shield for reducing impedance of a shielding of a SCART connector at high frequencies, the shield comprising:

a metallic sheet having a first end and a second end; and each of the first and second ends being configured to respectively extend along and adjacent to a respective first and second connector socket of the SCART connector when the metallic sheet is coupled to the SCART connector;

wherein the metallic sheet defines an opening between the first and second end, and the metallic sheet defines a first and second channel between the respective first and second end and the opening, each of said channel having:

a first side wall terminating at the respective first and second ends;

a second side wall opposite the first side wall and proximate to the opening between the first and second ends; and a top wall connects the respective first and second side walls.

2. An assembly for reducing impedance of a SCART connector at high frequencies, the assembly comprised of:

a metallic shield having a first end and a second end, said metallic shield having the first end positioned adjacent to a first surface of a SCART sidewall proximal to a plurality of SCART receiving sockets and a second end adjacent to a second surface of the SCART sidewall distal to the plurality of SCART receiving sockets; and a conductive chassis surrounding a particular piece of electronic equipment connected to the SCART sockets contacting a portion of the metallic shield adjacent to the second side of the SCART sidewall;

wherein each of the first and second ends extends along and adjacent to a surface of a respective first and second connector socket, and wherein the metallic shield has a metallic sheet with a first end and a second end, and the metallic sheet defines an opening between the first and second end, and the metallic sheet defines a first and second channel between the respective first and second end and the opening, each of said channel having:

a first side wall terminating at the respective first and second ends;

a second side wall opposite the first side wall and proximate to the opening between the first and second ends; and a top wall substantially perpendicular to the respective first and second side walls connecting said respective first and second side walls.

3. The assembly of claim 2, wherein a portion of a first connector socket is positioned within the first channel and a portion of a second connector socket is positioned within the second channel.

4. The assembly of claim 2, wherein the first and second side walls of the respective channels is substantially perpendicular to a portion of the metallic sheet defining the opening.

5. The assembly of claim 2, wherein the second side wall of each respective channel is adjacent to the chassis.

6. The assembly of claim 2, wherein a connecting device extends through the opening.

7. The assembly of claim 6, wherein the connecting device is a connecting bolt.

8. An assembly for reducing impedance of a SCART connector at high frequencies, the assembly comprised of:

a metallic shield having a first end and a second end, said metallic sheet defining a channel between the first end and the second end, the channel having a first side wall terminating at the first end, a second side wall terminating at the second end where said second end is angled approximately 90° from a plane defined by the second side wall, and a top wall connects said respective first and second side walls;

the first side wall of the metallic shield is positioned adjacent to a first surface of a SCART sidewall proximal to a plurality of SCART receiving sockets and the second side wall of the metallic shield is adjacent to a second surface of the SCART sidewall distal to the plurality of SCART receiving sockets, said second side wall terminating at the second end where the second end is angled approximately 90° from a plane defined by the second side walk;

a conductive chassis surrounding a particular piece of electronic equipment is adjacent to the second sidewall of the metallic shield; and a second metallic shield is positioned adjacent to a second sidewall of the SCART opposite the first sidewall, and a metallic band connects the two metallic shields, said metallic band extending around an outer sidewall of the SCART connector.

9. The assembly of claim 8, wherein a second metallic band connects the two metallic shields, said second metallic band extending around an outer sidewall of the SCART connector opposite the first metallic band.

* * * * *